US005774070A

United States Patent [19]

Rendon

[11] Patent Number: 5,774,070

[45] Date of Patent: Jun. 30, 1998

[54] METHOD AND SYSTEM FOR THE PRECISE THERMAL MAPPING OF ROADS, RUNWAYS AND THE LIKE FOR WINTERTIME SAFETY MONITORING AND MAINTENANCE

[76] Inventor: Edward Rendon, 3415 E. 21st St., Vancouver, Wash. 98661

[21] Appl. No.: 755,505

[22] Filed: Nov. 22, 1996

Related U.S. Application Data

[60] Provisional application No. 60/007,444 Nov. 22, 1995.

[51] Int. Cl.[6] ..... G08G 1/09

[52] U.S. Cl. ..... 340/905; 340/990; 701/35; 701/208

[58] Field of Search ..... 340/905, 988, 340/901, 904, 990, 580, 602; 364/449.7; 342/457; 701/208, 35

[56] References Cited

U.S. PATENT DOCUMENTS

| | | | |
|---|---|---|---|
| 4,274,091 | 6/1981 | Decker | 340/905 |
| 5,170,164 | 12/1992 | Lewis | 340/988 |
| 5,270,708 | 12/1993 | Kamishima | 340/905 |
| 5,402,117 | 3/1995 | Zijderhand | 340/905 |
| 5,416,476 | 5/1995 | Rendon | 340/905 |
| 5,521,594 | 5/1996 | Fukushima | 340/905 |
| 5,619,193 | 4/1997 | Doherty et al. | 340/905 |

*Primary Examiner*—Brent A. Swarthout
*Attorney, Agent, or Firm*—Olson & Olson

[57] ABSTRACT

A method and system for detecting actual road surface temperature and other conditions from mobile units traveling about roadways and the like throughout a given area and transmitting that detected information, tagged to accurate, corresponding longitude and latitude positional information identifying the location of the detected information and transmitting the resulting information to a base station where the temperature and other information is accurately plotted on a computer-generated map, whereby viewing personnel may determine the effective and efficient dispatching of ice-related material application equipment and personnel.

2 Claims, 1 Drawing Sheet

METHOD AND SYSTEM FOR THE PRECISE THERMAL MAPPING OF ROADS, RUNWAYS AND THE LIKE FOR WINTERTIME SAFETY MONITORING AND MAINTENANCE

This application claims the benefit of Provisional application Ser. No. 60/007,444, filed 22 Nov. 1995.

BACKGROUND OF THE INVENTION

This invention relates primarily to the wintertime monitoring of roads, runways and other trafficways for detecting icing, potential icing and other adverse conditions that indicate the need for special maintenance attention, such as the application of gravel or chemicals to the icy or potentially icing road surfaces.

Heretofore it has been common in the wintertime maintenance of expanses of roads during potentially icy conditions, for sanding, salting, graveling and chemical-applying crews to be sent out to apply truckloads of material to roadways based simply upon traffic patterns and the volume of traffic anticipated on the roadways throughout the city irrespective of the currently- existing conditions of the roadways with respect to their actual potential for forming ice at the time. In the absence of actual road temperature and friction monitoring of road surfaces throughout the area, this "saturation" type graveling of roads throughout a city was the only sure option a maintenance department had in dealing with the dangerous potential of ice formation on roadways.

Unfortunately, as disclosed in great detail in my earlier invention, METHOD AND SYSTEM FOR DETECTING ICY CONDITIONS ON ROADS, now issued under U.S. Pat. No. 5,416,476 dated 16 May 1995, it is now known that it is the actual temperature of the road surface material itself that determines the potential for ice formation thereon, and the efficient application of sand, gravel and chemicals needs therefore to be based on the actual monitored temperature conditions of the road surfaces. The simple and arbitrary, widespread spreading of materials over roadways throughout a city is an horrendously expensive and time-consuming operation requiring an equally extensive cleanup operation that even worse, cannot prioritize the application of material according to actual need. Consequently, great amounts of time and material are absolutely wasted tending to roadways that do not have the immediate potential for forming ice, while other roads that are in immediate need of attention are deferred until a later time according to a traditional and arbitrary schedule.

There therefore exists a need, particularly with the advent of new and expensive application chemicals, for a more concerted and efficient method and system for monitoring potential icing conditions on a large scale whereby the dispatching of road crews can be done on a basis that prioritizes the actual need for attention based on actual monitored road conditions existing throughout the area, whereby to maximize the efficiency of the maintenance operation, eliminate wasted time and material, and thereby greatly reduce the overall cost of the operation as a whole, while at the same time actually increase the public's safety in wintertime traveling.

SUMMARY OF THE INVENTION

In its basic concept, this invention provides a method and system for the ongoing monitoring of roads and runways throughout an area by remote, preferably mobile stations collecting road surface temperature, friction and other information; continuously tagging the detected information with its precise, accurate location; communicating the information to a central base station where the information is mapped and may be displayed so that potential icing conditions and trends indicating potential icing conditions can be identified by precise location; and an efficient plan of dispatching road crews could be made based on actual conditions and trends existing at the time for maximum efficiency.

It is by virtue of the foregoing basic concept that the principal object of this invention is achieved; namely the provision of a method and system of the class described which overcomes the disadvantages and limitations of the prior art and maximizes the efficiency of wintertime road maintenance departments, increases the public's safety by making more effective use of icing-related material applied to roadways and runways, and greatly reduces the heretofore inevitable wasting of material, time and resulting costs inherent in earlier wintertime road maintenance operations.

The foregoing and other objects and advantages of this invention will become apparent from the following detailed description, taken in connection with the accompanying drawing of a system embodying the features of this invention.

DESCRIPTION OF THE PREFERRED EMBODIMENT

Figure 1:
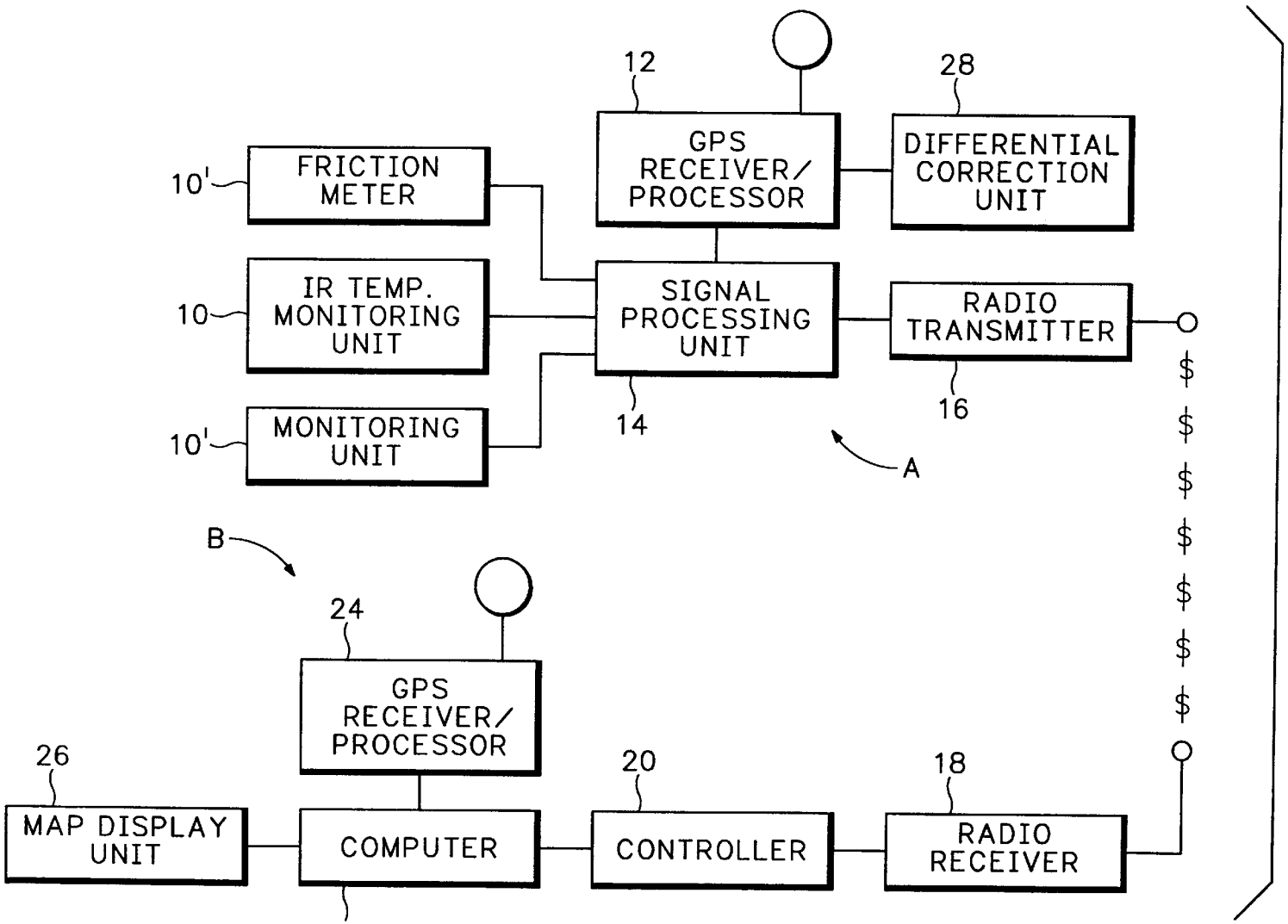
FIG. 1 is a schematic diagram illustrating the basic components of a thermal mapping system embodying the features of this invention having a base station and one remote, preferably mobile station. Although only one remote station is illustrated, a plurality may be provided, each communicating information to the base station, as may be needed or desired to cover a large area.

The present invention provides a novel method and system for accurately and previsely mapping and monitoring thermal and other conditions, such as friction, of roadways, airport runways and such, utilizing the principles of inverted differential global positioning systems (GPS) in conjunction with discoveries I have made in connection with my earlier invention, METHOD AND SYSTEM FOR DETECTING ICY CONDITIONS ON ROADS, U.S. Pat. No. 5,416,476 issued 16 May 1995.

As shown in the drawing, my invention includes one or more mobile, roving, vehicle-mounted temperature and position monitoring stations A, each station having a infrared road temperature monitoring system 10 substantially as disclosed in my earlier patent identified above. Additional monitoring units 10', such as a road friction meter may also be provided as needed or desired for the purpose. The system also includes a Trimble or equivalent GPS receiver and associated microprocessor 12, a remote signal processing unit 14 arranged to process the instantaneous temperature information from the infrared temperature monitoring system 10 and other monitor units 10', tagging them to and along with the current longitude and latitude information corresponding to the location of that instantaneous temperature reading, as provided by the GPS receiver 12. The signal processing unit 14 outputs to output communication means illustrated herein as a radio transmission unit 16 which transmits the processed temperature, friction, position and other monitored data to the radio receiver 18 of a base station B yet to be described.

If desired, the various data such as temperature, friction, position, etc., could be stored on an on-board computer and later communication to the base station either by radio, magnetic media, or by direct link to the base station computer. Also if desired, the microprocessor in the mobile station could include a monitor for a visual display of the processed data as well as a display of the mapped data as will become clear later. Further, a differential correction unit 28 and associated service, such as that provided by Differential Corrections Incorporated (DCI) may, and preferably is included with the GPS receiver 12, for processing and transmission of the correction information with the other processed data, whereby highly precise and accurate location information is tagged to the monitored data. In this manner, extremely accurate mapping of actual road surface conditions may be achieved.

The base station B, as previously mentioned, includes a cooperating communication means illustrated herein as a radio receiver 18 which receives the transmitted and processed radio signals from each of the mobile stations and delivers those signals to a system controller 20 which converts the information from radio frequency back into temperature, friction and position digital data which in turn is delivered to a computer 22 for further processing. The base station is also preferably provided with a GPS receiver 24 communicating with the computer 22 and used in conjunction therewith in determining the inverted differential correction based on a known "benchmark" position associated with the area hosting the base station. In this manner, mapping software which is provided on the base station computer accurately and precisely plots the area on a video or print-out map display 26, the computer inserting the reported road surface temperature, friction and other surface conditions as reported by the mobile stations onto the map precisely in their proper corresponding positions.

In receiving position signals from the GPS receiver 24, the base station performs a "base station" differential correction using the known benchmark position data received from the U.S. Department of Defense Satellite System. Additional, the base station receives radio frequency signals of temperature, friction and other variables, and position from the remote mobile station or stations. The base station also determines if the data from the mobile stations is transmitted with correction by others, and will perform the proper corrections automatically as required and plots the position of the mobile stations and the corresponding temperatures on a thermal map video display, a friction conditions map, a combination of thermal and friction conditions, a combination of other variables, etc. whereby the conditions of the surveyed area may be very accurately and continuously monitored for necessary attention and maintenance. In this manner, as the mobile stations traverse their designated areas, instantaneous road condition data is collected and may be continuously updated as frequently as may be desired or deemed advisable. In this way, road cooling rates and trends can be determined and application schedules arranged to make most effective use of the material and manpower. Also, once data is collected over time, seasonal trends for potential icing of roads throughout an area may be ascertained, thereby helping in the forecasting of seasonal materials purchases, employee hiring and other related cost factors.

Transmission of data from the remote units to the base station may be made in a number of communication modes, as mentioned earlier. For example, data may be transmitted by radio directly and continuously in a real-time mode, or in periodic "burst" mode of accumulated data, or by magnetic media physically brought to the base station, or by direct computer to computer link, all of which are standard modes of communication in the art. In addition, multiple remote stations operating simultaneously may communicate with the base station in one form while others communicate in other forms. That is, one mobile station may communicate directly by radio while another may communicate by "burst" radio mode when in proximity of the base station while others might communicate by magnetic media or by direct link to the base station computer. These various methods of communication are selected by the availability, cost or other requirements of the operator.

From the foregoing it will be apparent to those skilled in the art that the method and system of this invention will find particular utility and advantage in a variety of specialized applications, as for example at airports where the monitoring and maintenance of runways and taxi-ways in cold and freezing weather conditions is of paramount importance to safety. In this manner with one or more mobile stations simply traveling about the aircraft road surface areas of the airport, constant monitoring and updating of the condition of the paved surfaces may simply and extremely accurately be obtained so that the maintenance personnel can be constantly and immediately apprised of areas that need attention and application of chemicals for potential icing. Indeed, the detected temperatures, surface friction and other variables sensed over an area also indicate trends in patterns that may require special attention and also what specific chemicals are indicated at certain points around the airport. Additionally, the ingress and egress roadways surrounding the airport for vehicular traffic could easily be monitored and maintained on the same basis using the same equipment and personnel.

Another identified use and advantage of the method and system of this invention is in connection with city, county and state road maintenance departments where the thermal mapping method and system of this invention could encompass large numbers of roads which could be monitored simply and easily with mobile stations in small vehicles providing road information to base stations which would then dispatch the heavy and costly equipment to only those particular locations that actually need such attention, when they actually need and would benefit from such attention.

It is to be understood that, although the remote stations A have been disclosed hereinbefore as preferably being mobile, there may be instances in which there are certain specific locations that require constant monitoring for the purpose. In such a case, the remote station A may of course be fixed and may include additional sensor units 10' in which other important variables such as conductivity data may also be transmitted in order to provide additional desired information such as for calculations of residual chemicals on road surfaces, etc.

Also, due to inaccuracies inherent in existing maps of many areas and the possibility that GPS signals are not continuously corrected by other providers in some locations, the corrections may not always be reliable in a given area. A "corrected" map for a specific area such as an airport containing navigational data may be included into the map base in such a case to allow that an uncorrected signal from remote station location will be tied by the position on the map and related map longitude and latitude to the "closest allowable" position on the map, greatly simplifying the magnitude of the task. This allows for the use of a combination of mapping, such as for a highway system which has defined areas not available to GPS positioning, such as tunnels or mountain valleys. The remote station, when the GPS signal is lost, would then rely on stored tunnel and valley data and a vehicle distance sensor 10' to store data in the tunnel and valley segment on the map and compute tunnel and valley position data when the satellite signals are again available. The tunnel and valley positions are then plotted in their correct positions as before.

From the foregoing it will be apparent to those skilled in the art that various changes, additions and modifications may be made in the size, shape, type, number and arrangement of parts and components described hereinbefore without departing from the spirit of this invention and the scope of the appended claims.

Having thus described the method and system of my invention and the manner in which it may be used, I claim:

1. A thermal mapping and monitoring system for the efficient and effective management and application of gravel, chemical and other wintertime road treatment materials associated with road surface icing and potential icing conditions, the system comprising:

a) at least one vehicle-mounted, roving mobile station for travel along roadways throughout a designated area, said roadways including, but not limited to, public streets, highways and interstates, and airport runways, taxiways and terminal approachways, each said mobile station comprising:

1) An infrared road temperature monitoring unit configured to detect infrared temperature radiation emitted by the material of a road surface as the mobile station travels therealong, the monitoring unit arranged to output detected road surface material temperature information as electronic signals to a signal processing unit, 2) Position locating means for accurately identifying the correct longitude and latitude information corresponding to the location of the mobile station during operation of the temperature monitoring unit, said corresponding location information being output as electronic signals to a signal processing unit, 3) A signal processing unit configured to receive said output electronic signals representing said detected temperature and identified position information and process said electronic signals into communicatable, processed output signals that correctly tag the detected road surface material temperature information with its particular, corresponding position information, and 4) Communication means for communicating the just-processed, tagged output signals by electronic radio signal transmission to a base station, b) a base station for communication with said mobile station as it travels along said roadways, the base station comprising:

1) communication means corresponding to said mobile station communication means, the base station communication means for receiving said just-processed, radio transmitted, tagged output signals from the traveling mobile stations and delivering the tagged, current temperature and position information to a computer, and 2) a computer, equipped for user-readable output, and programmed with an accurate map of roadways of the designated area, the computer further programmed to process the tagged information and plot the particular communicated, processed, current temperature information accurately onto the map in proper, corresponding position thereon utilizing the communicated, corresponding position information tagged to the particular temperature information, c) whereby said information may be collected, processed and transmitted by the mobile station independently of the involvement of and distraction to the personnel in the vehicle as the vehicle travels along roadways and, substantially simultaneously, personnel at a remote base station viewing the map of a designated area are provided with accurate, current and easily updatable road surface material temperature information upon which to base the most effective and efficient dispatching of material application crews to optimize the use of material and manpower while enhancing the public's safety.

2. A method for determining the effective and efficient management and application of gravel, chemical and other wintertime road treatment materials associated with current and evolving road surface icing and potential icing conditions on roadways throughout a designated area, the method comprising:

a) detecting the infrared temperature radiation information emitted by road surface material at a plurality of points along roadways throughout a designated area using at least one mobile station, b) electronically identifying the correct longitude and latitude position information that corresponds to the points that the temperature radiation information was detected, c) correctly tagging the detected temperature information and corresponding positional information together into a processed, radio-transmittable electronic signal, d) communicating the tagged-together information by radio transmission to a computer-generated, accurate roadway map of the designated area at a base station remote from said at least one mobile station, wherein temperature information is plotted and displayed on the map according to the tagged location information so that the temperature information is displayed on the map in position actually corresponding to the roadway location at which the temperature information was detected, e) whereby personnel viewing the plotted road map of the designated area can dispatch material application materials and crews according to actual, current road surface temperature conditions and trends.

* * * * *